US010042326B2

(12) United States Patent
Nicolas et al.

(10) Patent No.: US 10,042,326 B2
(45) Date of Patent: Aug. 7, 2018

(54) WATCH BRACELET

(71) Applicant: Omega SA, Bienne (CH)

(72) Inventors: Cedric Nicolas, Neuchatel (CH); Dimitri Fostinis, Moutier (CH)

(73) Assignee: Omega SA, Bienne (CH)

( * ) Notice: Subject to any disclaimer, the term of this patent is extended or adjusted under 35 U.S.C. 154(b) by 0 days.

(21) Appl. No.: 15/284,029

(22) Filed: Oct. 3, 2016

(65) Prior Publication Data

US 2017/0168458 A1 Jun. 15, 2017

(30) Foreign Application Priority Data

Dec. 15, 2015 (EP) ..... 15200076

(51) Int. Cl.
*G04B 47/06* (2006.01)
*G04G 21/00* (2010.01)
(Continued)

(52) U.S. Cl.
CPC ..... *G04B 47/066* (2013.01); *A44C 5/0007* (2013.01); *G04B 37/08* (2013.01);
(Continued)

(58) Field of Classification Search
CPC .... G04B 37/14; G04B 37/1486; G04B 37/16; G04B 47/06; G04B 47/063; G04G 21/00; G04G 21/02; G04G 21/025; G06F 1/163
See application file for complete search history.

(56) References Cited

U.S. PATENT DOCUMENTS 4,783,772 A * 11/1988 Umemoto ..... B63C 11/02 368/11
6,619,836 B1 9/2003 Silvant et al.
(Continued)

FOREIGN PATENT DOCUMENTS

| | | |
|---|---|---|
| EP | 1 544 696 A2 | 6/2005 |
| FR | 2 641 092 A1 | 6/1990 |
| WO | WO 01/35173 A1 | 5/2001 |

OTHER PUBLICATIONS

European Search Report dated Jun. 13, 2016 in European application 15200076.6, filed on Dec. 15, 2015 (with English Translation of Categories of cited documents & Written Opinion).
(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A bracelet or strap for a watch case including a first arm inside which is housed a first printed circuit portion and a second arm, where the first arm is extended by a median part arranged to be situated underneath the watch case and which includes a second printed circuit portion connected to the first printed circuit portion by electrical connection, where the first printed circuit portion carries at least one electrical energy source and a microcontroller for powering and controlling a pressure sensor, where the median part is covered by an insert arranged to act as a seat for the watch case, where a housing, inside which the pressure sensor is arranged, is provided in the insert and communicates with the exterior to allow the pressure sensor to be placed in contact with a surrounding medium, and the pressure sensor is mounted on the second printed circuit portion with the insertion of a sealing gasket between the housing and the second printed circuit portion.

14 Claims, 8 Drawing Sheets

(51) Int. Cl.

| | |
|---|---|
| ***G04G 21/02*** | (2010.01) |
| ***A44C 5/00*** | (2006.01) |
| ***G04B 37/14*** | (2006.01) |
| ***G04B 37/08*** | (2006.01) |

(52) U.S. Cl.
CPC ..... *G04B 37/1486* (2013.01); *G04B 47/063* (2013.01); *G04G 21/00* (2013.01); *G04G 21/02* (2013.01)

(56) References Cited

U.S. PATENT DOCUMENTS

| | | | | |
|---|---|---|---|---|
| 9,612,617 | B1 * | 4/2017 | Jaulerry | G04B 37/08 |
| 9,645,610 | B1 * | 5/2017 | Chang | G06F 1/163 |
| 2001/0043514 | A1 | 11/2001 | Kita | |
| 2012/0194976 | A1 | 8/2012 | Golko et al. | |
| 2014/0174958 | A1 * | 6/2014 | Martinez | G06F 15/00 206/37 |
| 2014/0313128 | A1 | 10/2014 | Golko et al. | |
| 2015/0286277 | A1 * | 10/2015 | Kim | G06F 3/015 345/156 |
| 2015/0333302 | A1 * | 11/2015 | Johns | G04B 37/1486 429/127 |
| 2016/0070234 | A1 * | 3/2016 | Lee | A44C 5/0007 368/282 |
| 2016/0070393 | A1 * | 3/2016 | Sharma | G04G 17/04 345/174 |
| 2016/0077548 | A1 * | 3/2016 | Lim | G06F 1/166 361/679.26 |
| 2016/0170445 | A1 * | 6/2016 | Wai | A44C 5/00 361/679.03 |
| 2016/0231712 | A1 * | 8/2016 | Ahamed | G04B 37/0008 |
| 2016/0324470 | A1 * | 11/2016 | Townsend | G04B 47/00 |

OTHER PUBLICATIONS

David Szondy "Kairos TBand turns almost any watch into a smartwatch", GIZMAG, http://www.gizmag.com/kairos-tband/34811/, Nov. 24, 2014, 3 pages.

* cited by examiner

WATCH BRACELET

This application claims priority from European Patent Application No 15200076.6 of Dec. 15, 2015, the entire disclosure of which is hereby incorporated herein by reference.

FIELD OF THE INVENTION

The present invention concerns a watch bracelet or strap. More specifically, the invention concerns a watch bracelet in which are housed one or more electronic components arranged to perform at least one electronic function.

BACKGROUND OF THE INVENTION

There is a strong trend in the current market relating to connected watches having one or more electronic functions and capable of communicating, for example, with mobile telephones of the smart phone type. In the case of connected watches, the emphasis is, however, placed more on the range of electronic functions that such watches offer their users than on the aesthetic, timekeeping and impermeable qualities of such watches. The connected watches currently available on the market are thus unattractive and relatively fragile objects whose daily use requires a great deal of care on the part of the user.

Among available electronic functions, it may be envisaged to provide a pressure sensor allowing the user to store dive parameters (dive time, depth reached, temperatures), and then to save the history of his dive in a smart phone or in a personal computer. The pressure sensor may be housed inside the watch bracelet, to avoid having to modify the watch case that houses a timepiece movement, which might be mechanical, electronic or electromechanical. The watch case thus maintains all of its aesthetic, impermeable and timekeeping properties, while offering the user additional electronic functions, thanks to the addition of the bracelet of the invention.

However, incorporating a pressure sensor in a bracelet poses a problem. Indeed, the pressure sensor must be in contact with the medium whose pressure is to be measured. In the case of a diver's watch, the pressure sensor must therefore be in contact with water, which poses serious problems particularly in terms of sealing. In fact, if the pressure sensor is housed inside the bracelet, an orifice must be provided therein so that the pressure sensor can be in contact with the water. Since the bracelets or straps of connected watches are usually made of elastomer, the orifice must thus be created at the time of moulding the elastomeric material, or cut into the elastomeric material after moulding. In both cases, this requires extremely precise positioning of the various bracelet components, which is very difficult to achieve in the case of industrial production and means that the orifice must be sealed, typically by bonding, which poses problems of long-term reliability. Indeed, the bracelet is constantly subjected to bending and twisting movements to adapt to the shape and to the movements of the user's wrist and is subjected to high pressure during underwater dives. The orifice therefore risks losing its impermeability, which may result in destruction of the electronic components housed inside the watch bracelet.

SUMMARY OF THE INVENTION

It is an object of the present invention to overcome these and other problems, by providing a bracelet or strap that will enable a function of measuring underwater dive parameters to be associated with a watch case.

To this end, the present invention concerns a bracelet or strap for a watch case comprising a first arm inside which is housed a first printed circuit portion and a second arm, the first arm being extended by a median part arranged to be situated underneath the watch case and which includes a second printed circuit portion connected to the first printed circuit portion by electrical connection means, the first printed circuit portion carrying at least one electrical energy source and a microcontroller for powering and controlling a pressure sensor, the median part being covered by a rigid insert arranged to act as a seat for the watch case, a housing, inside which the pressure sensor is arranged, being provided in the insert and communicating with the exterior to allow the pressure sensor to be placed in contact with the surrounding medium, the pressure sensor being mounted on the second printed circuit portion with the insertion of a sealing gasket between the housing and the second printed circuit portion.

According to one embodiment of the invention, a third printed circuit portion housed in the second arm and carrying at least one other electronic component is connected to the first printed circuit portion housed in the first arm via the second printed circuit portion.

According to another embodiment of the invention, the first, second and third printed circuit portions are made in one piece.

According to yet another embodiment of the invention, the median part comprises at least one arch portion.

As a result of these features, the present invention provides a bracelet or strap for a watch case inside which is housed a pressure sensor for measuring pressure during underwater dives. The fact that the pressure sensor is housed inside the insert provides the sensor with a rigid housing which can be made impermeable by means of a simple sealing gasket. This therefore removes the risk of the electrical and electronic components housed inside the bracelet being damaged or destroyed by water ingress. Moreover, the pressure sensor is mounted simply by fixing the latter to the second printed circuit portion and then orienting the insert in a suitable manner and covering the second printed circuit sheet with the insert, ensuring that the pressure sensor penetrates the housing arranged inside the insert. It is noted, therefore, that the operations for mounting the pressure sensor are very simple and can easily be automated. Finally, because the pressure sensor is placed in contact with water via the housing arranged in the insert, here too, there is no risk of damage under the effect of water pressure or deformation of the bracelet.

If the bracelet is worn out or if the electrical energy source that it contains is exhausted, it can easily be exchanged for a new bracelet. Of course, according to a variant, the electrical energy source may also be rechargeable or replacable.

According to an additional advantage of the invention, the fact that printed circuit sheets are disposed in the two bracelet strands and that these printed circuit sheets are also electrically connected to each other means it is possible to increase the number of electronic components housed inside the bracelet and thus to increase the number of electronic functions available to the user, or to distribute the electronic components in an optimum manner between the two bracelet strands.

BRIEF DESCRIPTION OF THE DRAWINGS

Other features and advantages of the present invention will appear more clearly from the following detailed description of one embodiment of the bracelet according to the invention, this example being given solely by way of non-limiting illustration with reference to the annexed drawing, in which.

DETAILED DESCRIPTION OF ONE EMBODIMENT OF THE INVENTION

The present invention proceeds from the general inventive idea which consists in associating a watch case containing a watch movement, preferably but not limited to a mechanical movement, with a bracelet or strap, in the thickness of which are housed at least one electrical energy source and a microcontroller for powering and controlling an underwater dive measurement sensor. This pressure sensor must enable a user to save the history of his dives (dive time, depth, temperature) and then transfer the information to a mobile telephone or a personal computer. To this end, the bracelet according to the invention includes a first arm inside which is housed a first printed circuit portion and which is extended by a median part arranged to be situated underneath the watch case and which includes a second printed circuit portion connected to the first printed circuit portion by electrical connection means. The first printed circuit portion carries at least one electrical energy source and a microcontroller for powering and controlling the pressure sensor, whereas the median part is covered by a rigid insert which serves as a seat for the watch case and in which are arranged two elements for guiding bars that allow the bracelet to be fixed to the watch case. In the thickness of one of these guide elements is provided a housing inside which is arranged the pressure sensor. This housing opens on one side on the median part to allow the pressure sensor to be fixed to the second printed circuit portion, and, on the other side, into the hole for passage of the pin to place the pressure sensor in communication with the water. A simple sealing gasket can efficiently isolate the electronic components housed inside the bracelet from water. Moreover, because the pressure sensor is disposed in a rigid housing, there is no risk of the pressure measuring system being damaged due to the deformations to which the bracelet is subjected when it is worn on the user's wrist.

Figure 1:
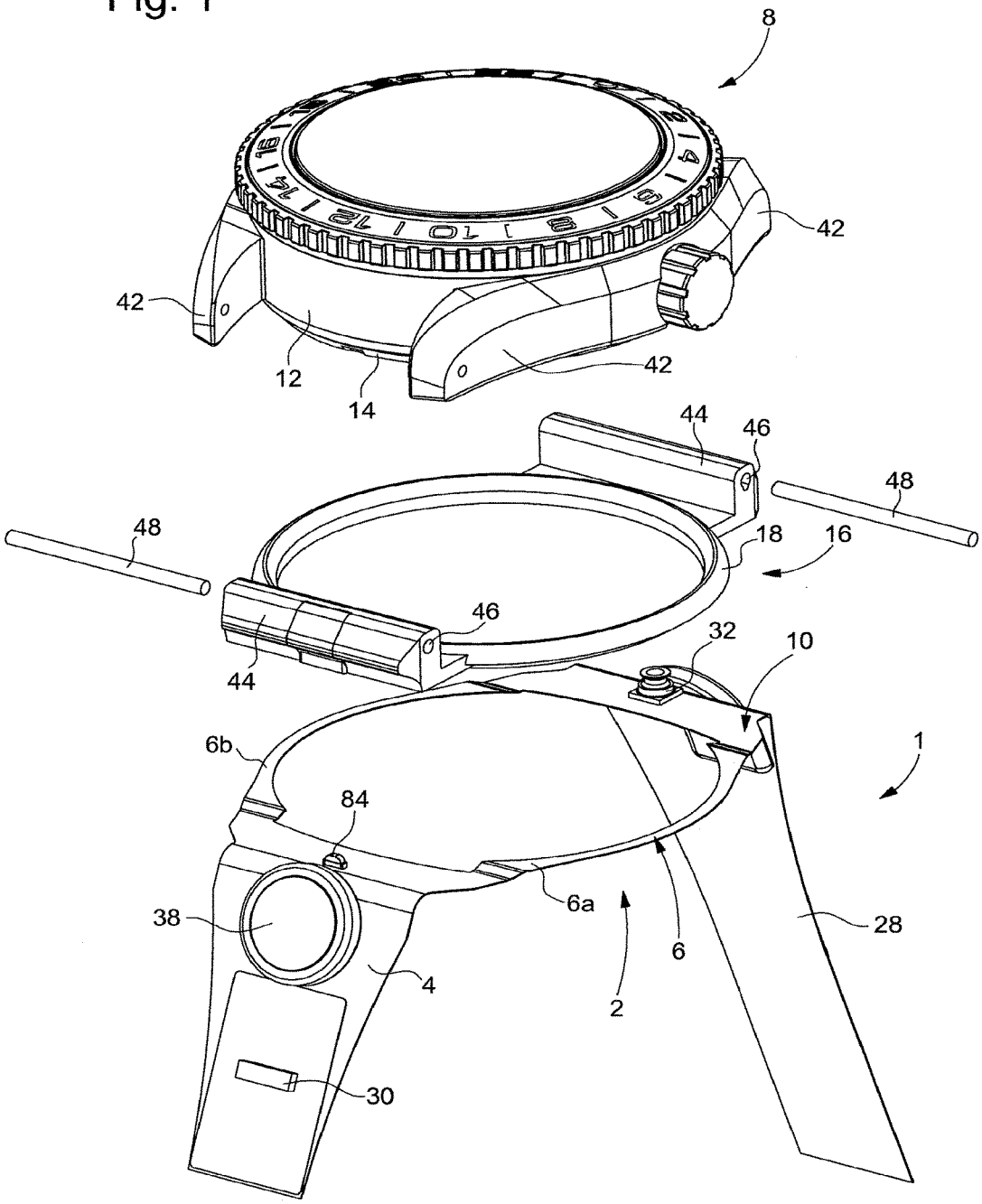
FIG. 1 is a perspective view of the bracelet according to the invention in an unassembled state, wherein a first printed circuit sheet is connected to a third printed circuit sheet via a median part arranged to be situated underneath a watch case, this median part including means for ensuring electrical continuity between the first printed circuit sheet and the third printed circuit sheet and being covered by a rigid insert which serves as a seat for the watch case.
Figure 2:
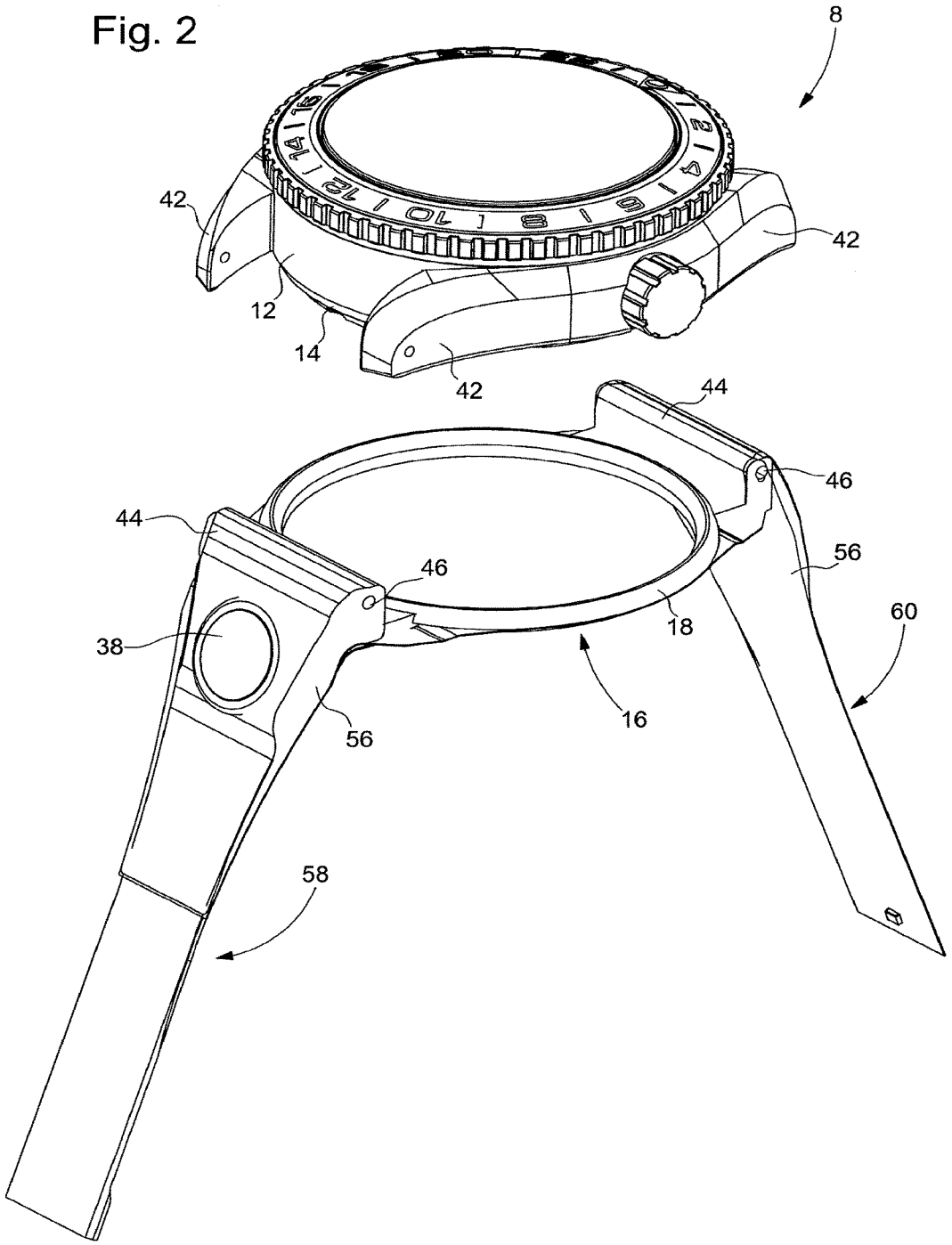
FIG. 2 is a similar view to that of FIG. 1 wherein the first printed circuit sheet and the third printed circuit sheet are overmoulded with a first layer of a plastic or elastomeric material.

FIG. 1 is a perspective view of the bracelet in an unassembled state according to one embodiment of the invention. Designated as a whole by the general reference numeral 1, this bracelet includes a printed circuit sheet 2 formed of a first printed circuit portion 4 extended by a median part 6 arranged to be situated underneath a watch case 8 and which includes a second printed circuit portion 10, connected to first printed circuit portion 4 by electrical connection means which ensure electrical continuity between first printed circuit portion 4 and second printed circuit portion 10.

Second printed circuit portion 10 could be electrically separate from first printed circuit portion 4. In such case, it would, however, be necessary to provide electrical connection means between first printed circuit portion 4 and second printed circuit portion 10, such as wires, which is not necessarily very convenient or very secure. This is why, according to the preferred embodiment of the invention, first printed circuit portion 4 and second printed circuit portion 10 are made in one piece. Median part 6 will thus also be formed of a portion of printed circuit sheet on which are structured electrically conductive path(s) to ensure electrical continuity with first printed circuit portion 4.

As shown, in particular in FIG. 1, median part 6, which is of approximately annular shape, is formed of two arch portions 6*a* and 6*b* which define an external diameter substantially corresponding to the external diameter of watch case 8, which is delimited by a case middle 12 and a case back 14. Watch case 8 is intended to be arranged above median part 6 with the insertion of an insert 16 between watch case 8 and median part 6. This insert 16 includes a stiff ring 18 whose geometry is similar to that of median part 6 and which is attached to median part 6 by any appropriate means, such as adhesive bonding. This stiff ring 18 gives median part 6 stiffness and mechanical strength and acts as a seat for watch case 8. It is understood that, owing to its ring-shape, median part 6 leaves the back cover 14 of watch case 8 visible.

Figure 3A:
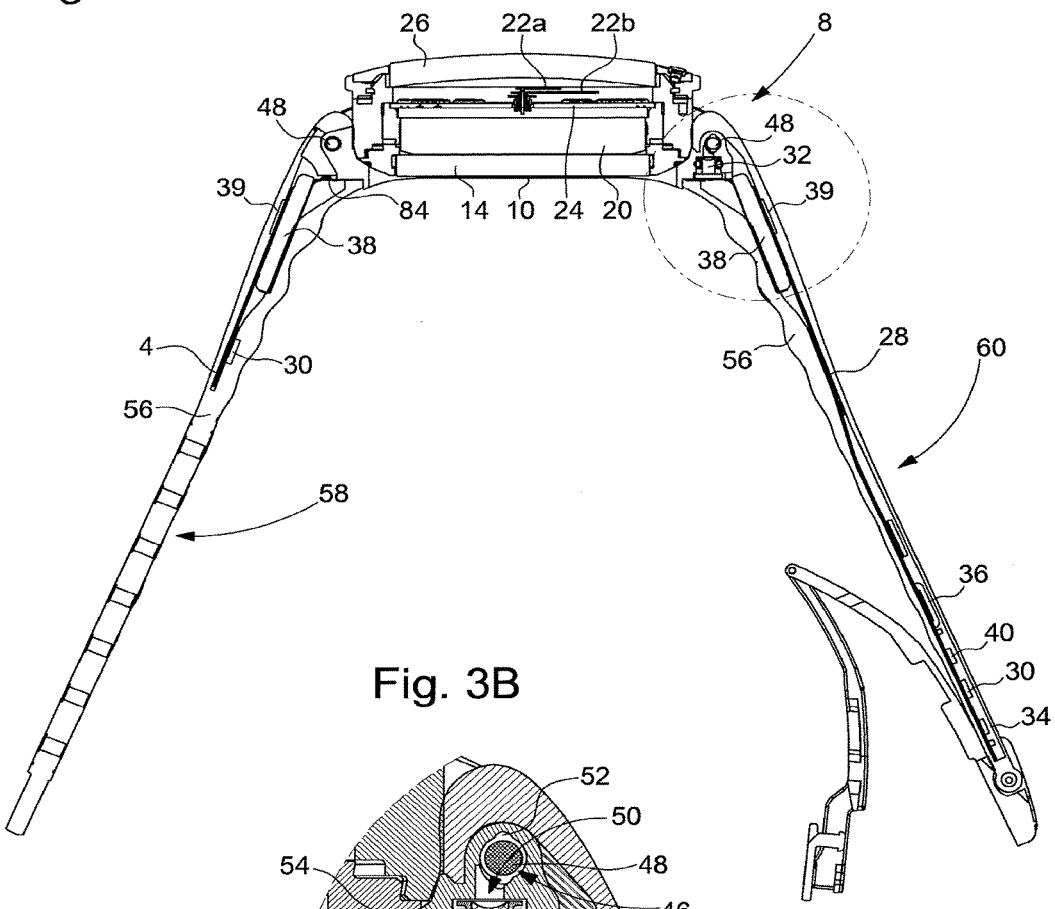
FIG. 3A is a vertical cross-section along the longitudinal axis of the bracelet of FIG. 2.

We will now examine bracelet 1 according to one embodiment of the invention, referring more particularly to FIG. 3A, which is a cross-sectional view on a plane extending along the longitudinal axis of bracelet 1. As shown by this Figure, watch case 8 contains a watch movement 20 which drives a set of hands: hour hand 22*a* and minute hand 22*b*. These hour and minute hands 22*a* and 22*b* move above a dial 24 and are covered by a crystal 26.

It is important to understand that the watch movement 20 housed inside watch case 8 may be of any type. It may be a purely mechanical movement, or a purely electronic movement, or an electromechanical movement. The mechanical or electronic nature of watch movement 20 is actually of no importance for the purposes of the present invention, given that watch case 8 is totally independent of bracelet 1 according to the invention and the addition of such a bracelet 1 does not require any modification of the various components housed inside watch case 8.

It is therefore understood from the foregoing that the present invention is particularly advantageous in the case where watch movement 20 is a mechanical movement.

Indeed, the addition of a bracelet 1 of the invention to a watch case 8 containing such a purely mechanical watch movement 20 enables unprecedented electronic functions to be offered to the user, without impairing the aesthetic appearance, mechanical qualities and sealing of watch case 8.

As mentioned above, bracelet 1 according to one embodiment of the invention includes a printed circuit sheet 2 formed of a first printed circuit portion 4 which, preferably, is made in one-piece with median part 6 which includes a second printed circuit portion 10 on which are structured the electrically conductive path or paths for ensuring electrical continuity with first printed circuit portion 4. It will become clear later in the present description that such an arrangement of printed circuits would be sufficient for the purposes of the present invention. However, according to a preferred embodiment of the invention, bracelet 1 includes a third printed circuit portion 28, which is electrically connected to first printed circuit portion 4 via median part 6 and which is made in one piece with the latter elements. Such an arrangement has numerous advantages, among which the following can be mentioned: the possibility of having more electronic components in the bracelet and thus of increasing the number of electronic functions available to the user, or of distributing the electronic components in an optimum manner between the two bracelet strands. In particular, it is possible to envisage mounting the electrical energy source(s) on one of the printed circuit sheets, and the electronic components on the other printed circuit sheet. It will also be understood that having more space available allows the designer to optimise ergonomics and interactions between the user and the bracelet.

As revealed by an examination of FIG. 3A, electronic components such as a microcontroller 30 for controlling a pressure sensor 32, an accelerometer 34 and a magnetic sensor 36 are mounted at the surface of third printed circuit portion 28. These electronic components are powered by an electrical energy source 38 which is also mounted on third printed circuit portion 28 and covered by a push-button 39. Likewise, an electrical energy source 38 covered by another push-button 39 and another microcontroller 30 are mounted at the surface of first printed circuit portion 4. Finally, an integrated circuit 40 capable of communicating with another device, for example using a Bluetooth, Wi-Fi or NFC interface, is mounted on third printed circuit portion 28.

An examination of FIG. 1 reveals, in particular, that watch case 8 includes two pairs of diametrically opposite horns 42 and insert 16 includes two guide elements 44 arranged to be placed between the respective pairs of horns 42 when watch case 8 is placed on insert 16. These two guide elements 44 are each pierced with a hole 46 for the passage of a pin 48 for attaching bracelet 1 to watch case 8.

Figure 3B:
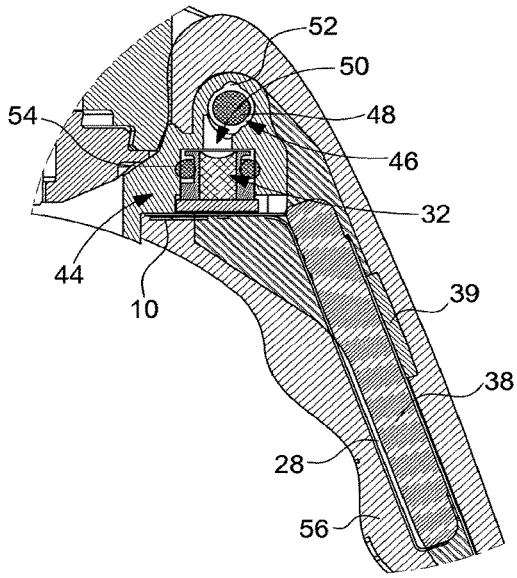
FIG. 3B is a larger scale view of the area surrounded by a circle in FIG. 3A.
Figure 7:
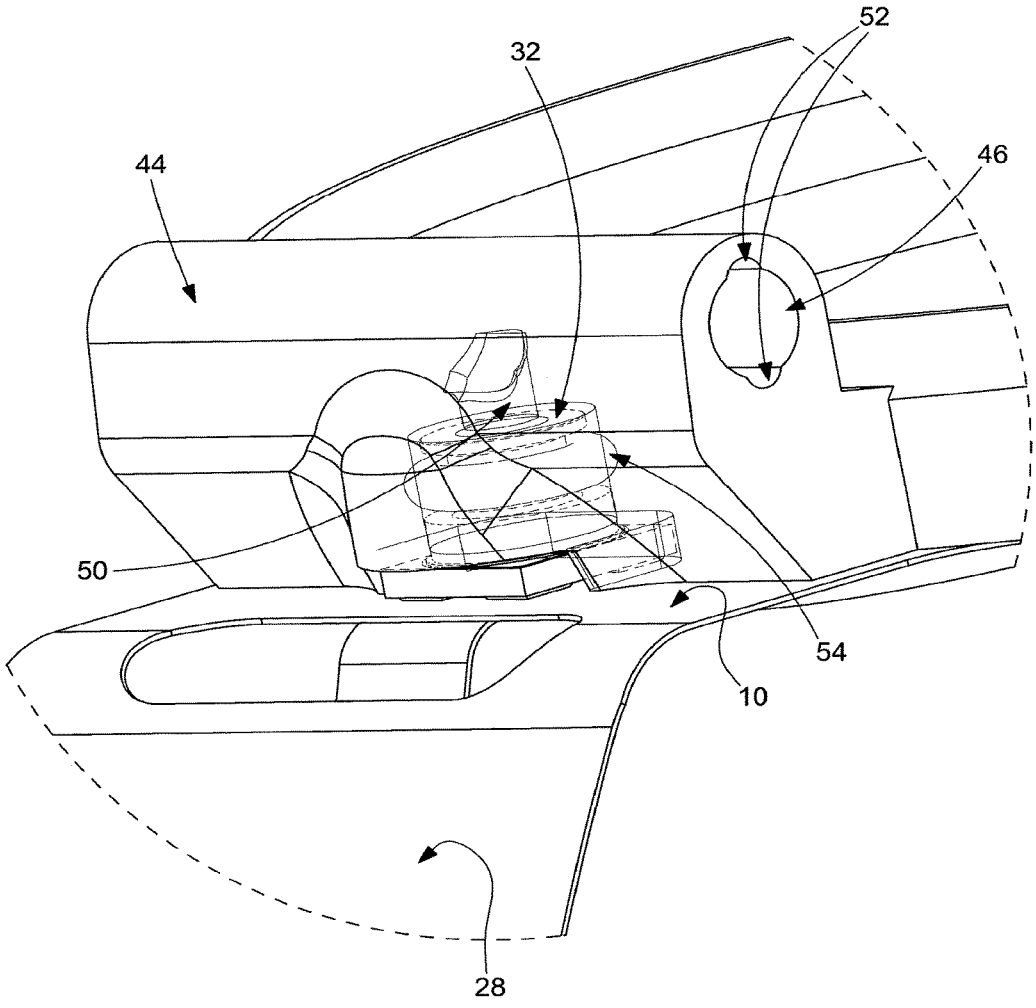
FIG. 7 is a larger scale detail of one of the elements for guiding the insert inside which is housed the pressure sensor with insertion of a sealing gasket.

According to the present invention and as seen in particular in FIGS. 3B and 7, a housing 50 provided inside the thickness of one of guide elements 44 can accommodate pressure sensor 32. This housing 50 opens on one side on median part 6 to allow pressure sensor 32 to be fixed to second printed circuit portion 10 and to be connected to microcontroller 30, and on the other side into hole 46 for the passage of pin 48 to place pressure sensor 32 in communication with water. Indeed, it is seen that hole 46 for the passage of pin 48 has a local increase in diameter 52 which does not hinder proper guiding of pin 48, but which creates a path for bringing water into contact with pressure sensor 32. A simple sealing gasket 54 seals housing 50 and efficiently isolates the electronic components housed inside bracelet 1 from water. Moreover, because pressure sensor 32 is disposed inside a rigid housing 50, there is no risk of the pressure measurement system being damaged due to the deformations to which bracelet 1 is subjected when it is worn on the user's wrist. Pressure sensor 32 is, for example, the sensor marketed by Measurement Specialities Inc. under the reference MS5837-30BA. This is a piezoresistive pressure sensor whose pressure sensing element is formed by stress gauges mounted in a Wheatstone bridge to maximise the sensor output signal and minimise its sensitivity to measurement error.

Figure 4:
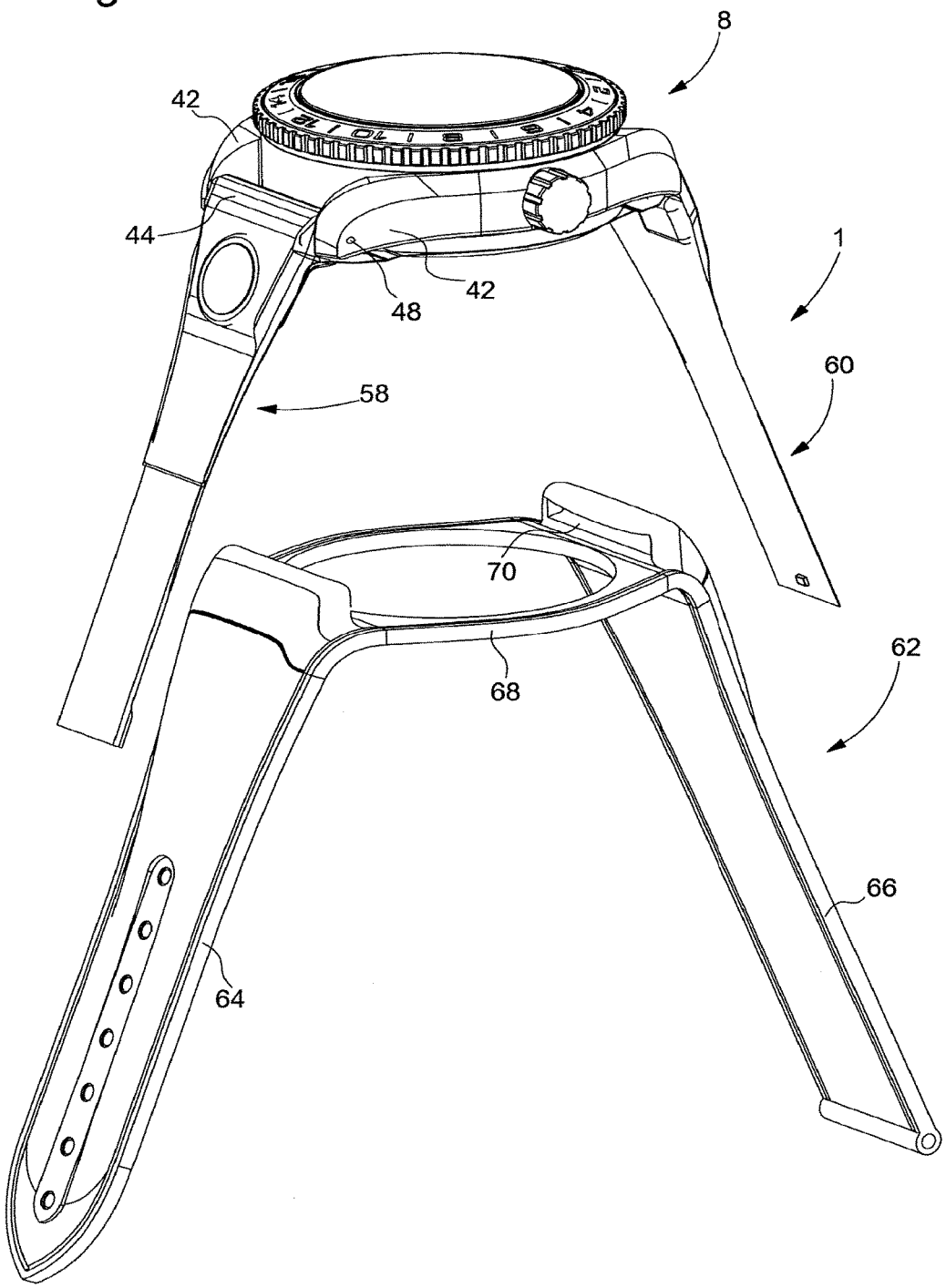
FIG. 4 is a view of a sleeve into which is inserted the bracelet of FIG. 2.

When all the electronic components are mounted on printed circuit portion 2 and insert 16 has been suitably arranged on median part 6, the assembly is overmoulded with a first layer 56 of plastic or elastomeric material in order to form first and second arms 58 and 60 (see FIG. 4). The purpose of this first overmoulding layer 56 is to protect the electronic components mounted on first and third printed circuit portions 4, 28 from external aggressions and to give the resulting arms 58 and 60 their shape and mechanical strength. Preferably, bars 48 are engaged through horns 42 and guide elements 44 at the time of the overmoulding operation in order to prevent holes 46 being clogged with the overmoulding material.

Figure 5A:
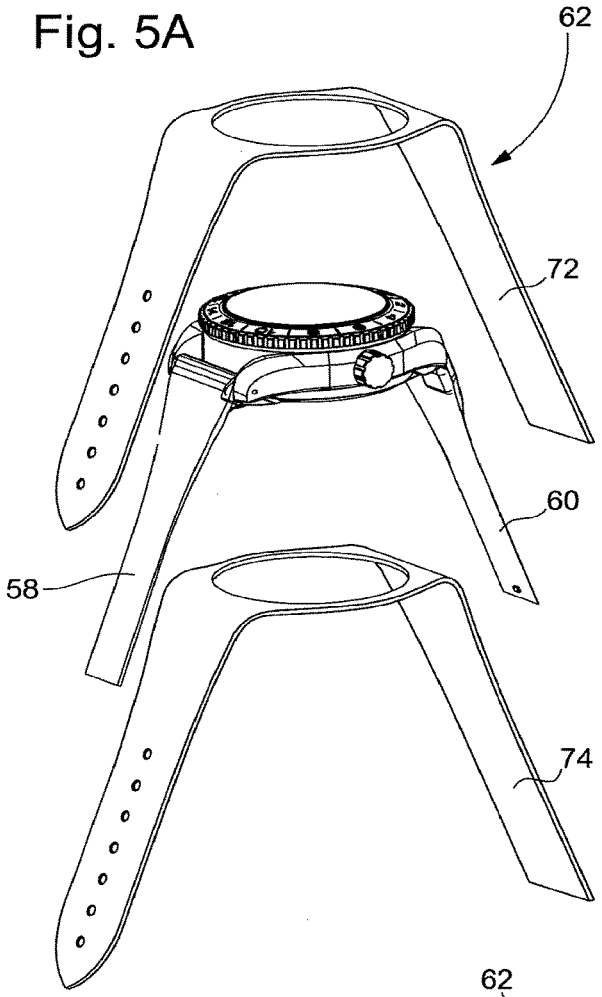
FIGS. 5A and 5B illustrate the case wherein the sleeve of FIG. 4 includes an upper band and a lower band between which is arranged bracelet according to one embodiment of the invention, and which are assembled to each other along their peripheral edges, for example, by a seam or by heat welding.
Figure 5B:
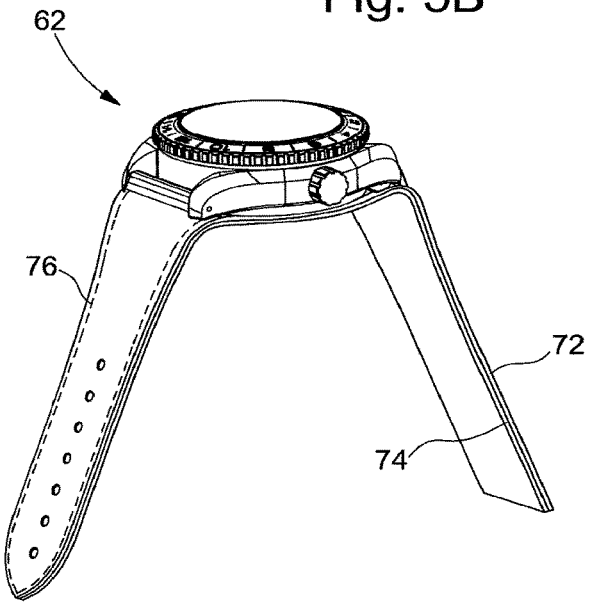

The bracelet 1 that results from the overmoulding operation and which includes the two arms 58, 60, connected to each other by median part 6 covered by insert 16, and in the thickness of which are housed the electronic components necessary for the execution of the desired electronic function(s) is then finally slid inside a sleeve 62 which, in the example shown in FIG. 4, includes a first strand 64 and a second strand 66 connected to each other by a connecting part 68, which is adapted in size and shape to receive median part 6 of bracelet 1, covered by insert 16. This sleeve 62 is, for example, obtained by moulding or injection moulding an elastomeric material while ensuring that first and second strands 64 and 66 are hollow and each provided with an opening 70 so that the two arms 58 and 60 can slide therein. According to a variant embodiment illustrated in FIGS. 5A and 5B, sleeve 62 includes an upper band 72 and a lower band 74 between which is arranged bracelet 1 according to the invention and which are assembled to each other along their peripheral edges 76, for example, by a seam or by heat welding.

Figure 6:
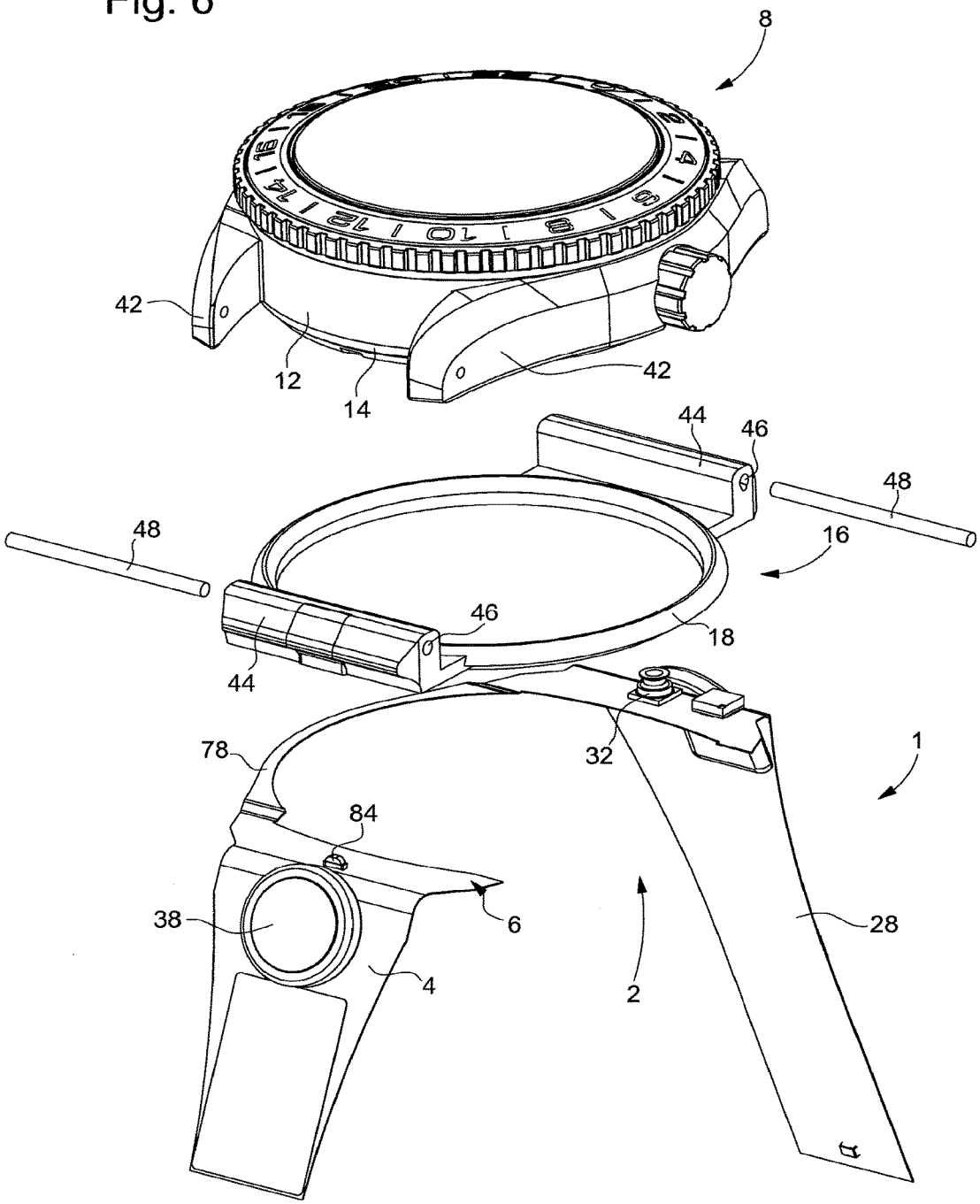
FIG. 6 illustrates the case wherein the median part has only one arch portion for carrying the conductive paths to electrically connect first and third printed circuit portions to each other.
Figure 8:
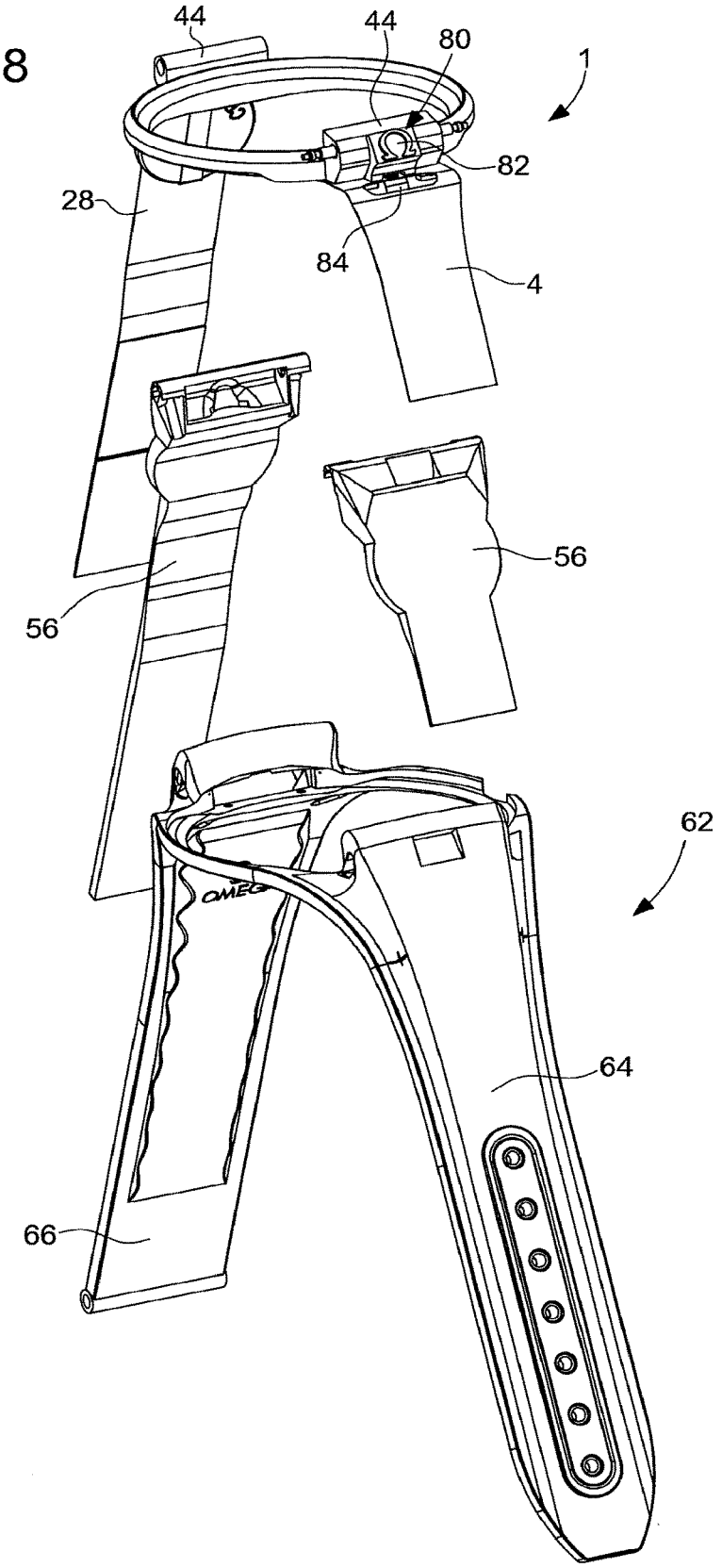
FIG. 8 is a larger scale detail of the other guide element inside which is housed a guide for conducting the light produced by a point light source towards the exterior.

It goes without saying that this invention is not limited to the embodiment that has just been described and that various simple modifications and variants can be envisaged by those skilled in the art without departing from the scope of the invention as defined by the annexed claims. In particular, a possible alternative to sleeve 62, would be to subject bracelet 1 according to the invention to a second overmoulding operation intended to cover the two arms 58, 60 and median part 6 which connects them, with a layer of a second plastic or elastomeric material, which may be the same or different from the material used for first overmoulding layer 56. Also, as illustrated in FIG. 6, median part 6 may have only one arch portion 78 to carry the conductive paths for electrically connecting first and third printed circuit portions 4 and 28 to each other. It is also noted (see FIG. 8) that a notch 80, provided in whichever guide element 44 does not accommodate the pressure sensor, can accommodate a transparent light guide 82 underneath which will be disposed a point light source 84, such as a light emitting diode, fixed on second printed circuit portion 10 and supplied with current by electrical energy source 38. Point light source 84 can indicate the operating state of pressure sensor 32 by means of a colour code. Finally, it is noted that, by pressing on push-buttons 39, it is, for example, possible to order microcontroller 30 to start to measure the pressure during an underwater dive, or, via integrated circuit 40, to order the transfer of data relating to an underwater dive to a remote device, such as a mobile telephone or a personal computer. It will be noted that by suitable programming of microcontroller 30, it is possible to enable the latter to distinguish, for example, between a short press and a long press on push button 39 or between a single press and a double press. If bracelet 1 is provided with two push-buttons 39, it is even possible to envisage using combinations of presses on the two push-buttons to enter commands into bracelet 1 according to the invention.

NOMENCLATURE

Bracelet 1
Printed circuit sheet 2
First printed circuit portion 4
Median part 6
Arch portions 6*a*, 6*b*
Watch case 8
Second printed circuit portion 10
Case middle 12
Case back 14
Insert 16
Stiff ring 18
Watch movement 20
Set of hands: hour hand 22*a* and minute hand 22*b*
Dial 24
Crystal 26
Third printed circuit portion 28
Microcontroller 30
Pressure sensor 32
Accelerometer 34
Magnetic sensor 36
Electrical energy source 38
Push-button 39
Integrated circuit 40
Pairs of horns 42
Guide elements 44
Hole 46
Pin 48
Housing 50
Increase in diameter 52
Sealing gasket 54
First layer 56
First arm 58
Second arm 60
Sleeve 62
First strand 64
Second strand 66
Connecting part 68
Opening 70
Upper band 72
Lower band 74
Peripheral edges 76
Arch portion 78
Notch 80
Transparent light guide 82
Point light source 84

What is claimed is:

1. A bracelet or strap for a watch case comprising:

a first arm inside which is housed a first printed circuit portion; and a second arm, wherein the first arm is extended by a median part arranged to be situated underneath the watch case, wherein the median part includes a second printed circuit portion, wherein the bracelet or strap further comprises electrical connection means for connecting the second printed circuit portion to the first printed circuit portion, wherein the first printed circuit portion carries at least one electrical energy source and a microcontroller for powering and controlling a pressure sensor, wherein the median part is covered by an insert arranged to act as a seat for the watch case, wherein a housing, inside which the pressure sensor is arranged, is provided in the insert and communicates with an exterior to allow the pressure sensor to be placed in contact with a surrounding medium, wherein the pressure sensor is mounted on the second printed circuit portion with the insertion of a sealing gasket between the housing and the second printed circuit portion, and wherein the insert includes two guide elements arranged to be placed between two respective pairs of horns carried by the watch case, wherein the guide elements each is pierced with a hole for the passage of a pin to enable the bracelet to be attached to the watch case, wherein the housing, inside which is arranged the pressure sensor, is arranged inside one of the guide elements and opens into the hole for passage of the corresponding pin, wherein the hole has on one part of the perimeter thereof a local increase in diameter in order to place the pressure sensor in contact with the surrounding medium.

2. The bracelet according to claim 1, wherein a third printed circuit portion which is housed inside the second arm and which carries at least one other electronic component, is connected to the first printed circuit portion housed inside the first arm via the second printed circuit portion.

3. The bracelet according to claim 2, wherein the first, second and third printed circuit portions are made in one piece.

4. The bracelet according to claim 3, wherein the median part includes at least one arch portion.

5. The bracelet according to claim 3, wherein the first arm and the second arm are formed respectively by the first printed circuit portion and the third printed circuit portion covered with a first overmoulding layer.

6. The bracelet according to claim 5, wherein the insert is also covered with the first overmoulding layer.

7. The bracelet according to claim 6, including a sleeve formed of a first strand and of a second strand connected to each other by a connecting part, wherein the first and second strands are hollow and are each provided with an opening, so that the first and second arms can slide therein.

8. The bracelet according to claim 7, wherein the sleeve is formed of an upper band and a lower band joined to each other along the peripheral edges thereof.

9. The bracelet according to claim 5, including a sleeve formed of a first strand and of a second strand connected to each other by a connecting part, wherein the first and second strands are hollow and are each provided with an opening, so that the first and second arms can slide therein.

10. The bracelet according to claim 9, wherein the sleeve is formed of an upper band and a lower band joined to each other along the peripheral edges thereof.

11. The bracelet according to claim 5, wherein the first and second arms are overmoulded with a second plastic or elastomeric material.

12. The bracelet according to claim 2, wherein the median part includes at least one arch portion.

13. A bracelet or strap for a watch case comprising:

a first arm inside which is housed a first printed circuit portion; and a second arm, wherein the first arm is extended by a median part arranged to be situated underneath the watch case, wherein the median part includes a second printed circuit portion, wherein the bracelet or strap further comprises electrical connection means for connecting the second printed circuit portion to the first printed circuit portion, wherein the first printed circuit portion carries at least one electrical energy source and a microcontroller for powering and controlling a pressure sensor, wherein the median part is covered by an insert arranged to act as a seat for the watch case, wherein a housing, inside which the pressure sensor is arranged, is provided in the insert and communicates with an exterior to allow the pressure sensor to be placed in contact with a surrounding medium, wherein the pressure sensor is mounted on the second printed circuit portion with the insertion of a sealing gasket between the housing and the second printed circuit portion, wherein the insert includes two guide elements arranged to be placed between two respective pairs of horns carried by the watch case, wherein the guide elements each is pierced with a hole for the passage of a pin to enable the bracelet to be attached to the watch case, wherein the housing, inside which is arranged the pressure sensor, is arranged inside one of the guide elements and opens into the hole for passage of the corresponding pin, wherein the hole has on one part of the perimeter thereof a local increase in diameter in order to place the pressure sensor in contact with the surrounding medium, and wherein a third printed circuit portion which is housed inside the second arm and which carries at least one other electronic component, is connected to the first printed circuit portion housed inside the first arm via the second printed circuit portion.

14. A bracelet or strap for a watch case comprising:

a first arm inside which is housed a first printed circuit portion; and a second arm, wherein the first arm is extended by a median part arranged to be situated underneath the watch case, wherein the median part includes a second printed circuit portion, wherein the bracelet or strap further comprises electrical connection means for connecting the second printed circuit portion to the first printed circuit portion, wherein the first printed circuit portion carries at least one electrical energy source and a microcontroller for powering and controlling a pressure sensor, wherein the median part is covered by an insert arranged to act as a seat for the watch case, wherein a housing, inside which the pressure sensor is arranged, is provided in the insert and communicates with an exterior to allow the pressure sensor to be placed in contact with a surrounding medium, wherein the pressure sensor is mounted on the second printed circuit portion with the insertion of a sealing gasket between the housing and the second printed circuit portion, wherein the insert includes two guide elements arranged to be placed between two respective pairs of horns carried by the watch case, wherein the guide elements each is pierced with a hole for the passage of a pin to enable the bracelet to be attached to the watch case, wherein the housing, inside which is arranged the pressure sensor, is arranged inside one of the guide elements and opens into the hole for passage of the corresponding pin, wherein the hole has on one part of the perimeter thereof a local increase in diameter in order to place the pressure sensor in contact with the surrounding medium, wherein a third printed circuit portion which is housed inside the second arm and which carries at least one other electronic component, is connected to the first printed circuit portion housed inside the first arm via the second printed circuit portion, and wherein the first, second and third printed circuit portions are made in one piece.

* * * * *